US010283292B2

(12) United States Patent
Weng et al.

(10) Patent No.: US 10,283,292 B2
(45) Date of Patent: May 7, 2019

(54) CUTOUT FOR USE IN ELECTRICAL DISTRIBUTION NETWORK

(71) Applicant: ABB Schweiz AG, Baden (CH)

(72) Inventors: Yinglei Weng, Fujian (CN); Zhanwei Tu, Fujian (CN); Jerzy Obojski, Kraków (PL); Minghai Fu, Fujian (CN)

(73) Assignee: ABB Schweiz AG, Baden (CH)

( * ) Notice: Subject to any disclaimer, the term of this patent is extended or adjusted under 35 U.S.C. 154(b) by 192 days.

(21) Appl. No.: 15/139,980

(22) Filed: Apr. 27, 2016

(65) Prior Publication Data

US 2016/0240336 A1 Aug. 18, 2016

Related U.S. Application Data

(63) Continuation of application No. PCT/CN2013/086238, filed on Oct. 30, 2013.

(51) Int. Cl.
*H01H 31/12* (2006.01)

(52) U.S. Cl.
CPC ..... *H01H 31/12* (2013.01); *H01H 31/127* (2013.01)

(58) Field of Classification Search
CPC ..... H01H 31/12
USPC ..... 174/73.1
See application file for complete search history.

(56) References Cited

U.S. PATENT DOCUMENTS 2,735,911 A * 2/1956 Sant ..... H01H 31/127 337/157
2,798,133 A * 7/1957 Curtis ..... H01H 85/42 337/177
3,026,391 A * 3/1962 Bridges ..... H01H 31/006 254/120

(Continued)

FOREIGN PATENT DOCUMENTS

CN 200965855 Y 10/2007
CN 201450327 U 5/2010

(Continued)

OTHER PUBLICATIONS

International Search Report and Written Opinion, PCT/US2013/086238, ABB Technology Ltd et al., dated Jul. 30, 2014.

(Continued)

*Primary Examiner* — Stanley Tso
(74) *Attorney, Agent, or Firm* — Taft Stettinius & Hollister LLP

(57) ABSTRACT

The embodiment of the present disclosure provides a cutout which can comprise a top contact assembly being capable of electrically coupled with a first electric cable; a bottom contact assembly being capable of electrically coupled with a second electric cable; an insulator assembly secured to the top contact assembly in a first end thereof, and secured to the bottom assembly in a second end thereof opposite to the first end; and a tube assembly having a fuselink placed therein for conducting electricity between the top contact assembly and a bottom contact assembly. The bottom contact assembly has (Continued)

a bottom contact member which is capable of electrically coupled with the second electrical cable at one end thereof, and removeably coupled with the tube assembly at the other end thereof, such that a current path is formed from the second electrical cable to the tube assembly via the bottom contact member.

4 Claims, 5 Drawing Sheets

(56) References Cited

U.S. PATENT DOCUMENTS 4,045,762 A * 8/1977 Foulkes ..... H01H 31/127 200/61.08
4,414,527 A * 11/1983 Biller ..... H01H 31/127 337/169
4,480,245 A 10/1984 Carothers et al.
5,300,912 A 4/1994 Tillery et al.
2005/0104709 A1* 5/2005 Montante ..... H01H 31/127 337/171
2011/0146106 A1* 6/2011 Kaufman ..... A43C 11/00 36/105

FOREIGN PATENT DOCUMENTS

CN 101855692 A 10/2010
CN 102789933 A 11/2012
WO 2011133485 A1 10/2011

OTHER PUBLICATIONS

Australian Examination Report, Australian Patent Application No. 2013404504, dated Oct. 26, 2016, 2 pages.
First Chinese Office Action, Chinese Patent Application No. 201380080507.6, dated Apr. 6, 2017, 5 pages including English Translation.
Chinese Search Report, Chinese Patent Application No. 201380080507.6, dated Apr. 6, 2017, 4 pages including English Translation.

* cited by examiner

CUTOUT FOR USE IN ELECTRICAL DISTRIBUTION NETWORK

FIELD OF THE INVENTION

Embodiments of the present disclosure relate to an electrical distribution device, and more specifically, to a cutout for use in an electrical distribution network.

BACKGROUND OF INVENTION

Typically, protective devices are provided to use in the electricity transmission system for disconnecting a circuit upon detection of a fault condition, e.g., lightning, to prevent power distribution equipments from being damaged. One of such protective devices is known as a cutout, which functions to disconnect a circuit when current in the circuit exceeds a threshold level.

Cutouts normally include a fuse element electrically coupled with its top contact assembly and bottom contact assembly. The fuse element will be melted when current is large enough. The top and bottom contact assemblies of the prior art cutout usually have a plurality of contact elements or current paths, and thus the reliability and conductivity of the top and bottom contact assemblies may be restrained. Therefore, there is a need in the art to come up with a cutout for improving the reliability and conductivity.

SUMMARY OF INVENTION

In view of above, one of the objectives of the present disclosure is to provide a cutout comprising a novel top contact assembly to overcome at least part of the deficiencies in the prior art.

Another objective of the present disclosure is to provide a cutout comprising a novel bottom contact assembly to overcome at least past of the deficiencies in the prior art.

A further objective of the present disclosure is to provide a cutout comprising a novel top contact assembly and a novel bottom contact assembly to overcome at least part of the deficiencies in the prior art.

According to one aspect of the present disclosure, there is provided a cutout comprising a top contact assembly being capable of electrically coupled with a first electric cable; a bottom contact assembly being capable of electrically coupled with a second electric cable; an insulator assembly secured to the top contact assembly in a first end thereof, and secured to the bottom assembly in a second end thereof opposite to the first end; and a tube assembly having a fuselink placed therein for conducting electricity between the top contact assembly and a bottom contact assembly. The bottom contact assembly has a bottom contact member which is capable of electrically coupled with the second electrical cable at one end thereof and removeably coupled with the tube assembly at the other end thereof such that a current path is formed from the second electrical cable to the tube assembly via the bottom contact member.

According to one embodiment of the present disclosure, the tube assembly can comprise an electrically conducting contact part at the bottom portion thereof, the fuselink is flexibly wrapped into and fixed by the electrically conducting contact part, and the electrically conducting contact part is removeably and electrically coupled with the bottom contact member.

According to one embodiment of the present disclosure, the bottom contact member has a recess for receiving a protrusion of the electrically conducting contact part of the tube assembly. The protrusion is shaped to be capable of being tilted relative to the bottom contact member while being constantly coupled with the bottom contact member.

According to one embodiment of the present disclosure, the electrically conducting contact part comprises an electrically conducting bolt and a nut. The protrusion of the electrically conducting contact part is formed by an end of the electrically conduct bolt facing the bottom contact member. The fuselink extended out of the bottom of the tube assembly can be wrapped into the electrically conducting bolt and is pressed against the nut.

According to one embodiment of the present disclosure, the contact part further comprises a fixing member on which the electrically conducting bolt is riveted, the fuselink is capable of being fixed between the nut and the fixing member despite variations on size of the fuselink, and at least one part of the fixing member is mechanically coupled with the tube assembly. In this configuration, fuselinks with variable sizes can be all fitted tightly to the contact part and the electrical contact between the tube assembly and the bottom assembly is constantly maintained during usage.

According to one embodiment of the present disclosure, the electrically conducting bolt and the nut are made of copper.

According to one embodiment of the present disclosure, the bottom contact member is formed as an inseparable member. In one exemplary embodiment, the bottom contact member is integrally made of copper.

According to one embodiment of the present disclosure, the tube assembly is pivotally coupled with the bottom contact assembly at the bottom portion thereof via a rotating axis of the tube assembly, such that the electrically conducting contact part is electrically coupled with the bottom contact member when the top portion of the tube assembly is coupled with the top contact member, and the contact part is decoupled from the bottom contact member when the top portion of the tube assembly departs from the top contact member in a manner of rotation about the rotating axis of the tube assembly.

According to one embodiment of the present disclosure, the bottom portion of the tube assembly and the bottom contact assembly are pivotally coupled by a hinge defining the rotating axis of the tube assembly. In one exemplary embodiment, the hinge is made of a composite material. In a further exemplary embodiment, the hinge is made of a metal alloy.

According to one embodiment of the present disclosure, the top contact assembly comprises a top contact member which is capable of electrically coupled with the first electrical cable at one end, and coupled with the tube assembly at the other end. The top contact member is formed as an inseparable member. In one exemplary embodiment, the top contact member is integrally made of copper.

According to one embodiment of the present disclosure, the top contact member has a recess which receives a protrusion of the top portion of the tube assembly, and the protrusion is shaped to be capable of being tilted relative to the top contact member while being constantly coupled with the top contact member.

According to a further aspect of the present disclosure, there is provided a cutout comprising a top contact assembly electrically coupled with a first electric cable; a bottom contact assembly electrically coupled with a second electric cable; an insulator assembly secured to the top contact assembly in a first end, and secured to the bottom assembly in a second end opposite to the first end; and a tube assembly having a fuselink placed therein for conducting electricity between the top contact member and the bottom contact member. The top contact assembly comprises a top contact member which is capable of electrically coupled with the first electrical cable at one end thereof, and coupled with the tube assembly at the other end thereof. The top contact member is formed as an inseparable contact member.

According to one embodiment of the present disclosure, the top contact member is integrally made of copper.

According to the embodiments of the present disclosure, the conductivity is improved by using less contacts and shorter current path. Therefore, the cost is reduced because the parts not involved in conducting current can be made of composite materials which are less costly compared with well conducting materials such as copper.

Further, embodiment of the present disclosure provide flexibility of the two ends of the tube assembly in contact with the top contact member and the bottom contact member, where certain misplacement of the contacts, such as tilting, rotating or sliding, is allowed with current stably supplied.

Further, a simpler assembly process is also achieved with the cutout of the present disclosure while keeping the mechanical robustness.

BRIEF DESCRIPTION OF DRAWINGS

Embodiments of the invention will now be described, by way of example only, with reference to the accompanying drawings, in which.

DETAILED DESCRIPTION OF EMBODIMENTS

Reference will now be made in detailed to several embodiments of the present disclosure, example of which are illustrated in the accompanying figures. It is noted that wherever practicable similar or like reference numbers may be used in the figures, and may indicates similar or like functionality. The figures depict embodiments of the present disclosure for purposes of illustration only. One skilled in the art will readily recognize from the following description that alternative embodiments of the structures and methods illustrated herein may be employed without departing from the principles of the present disclosure described therein.

Figure 1:
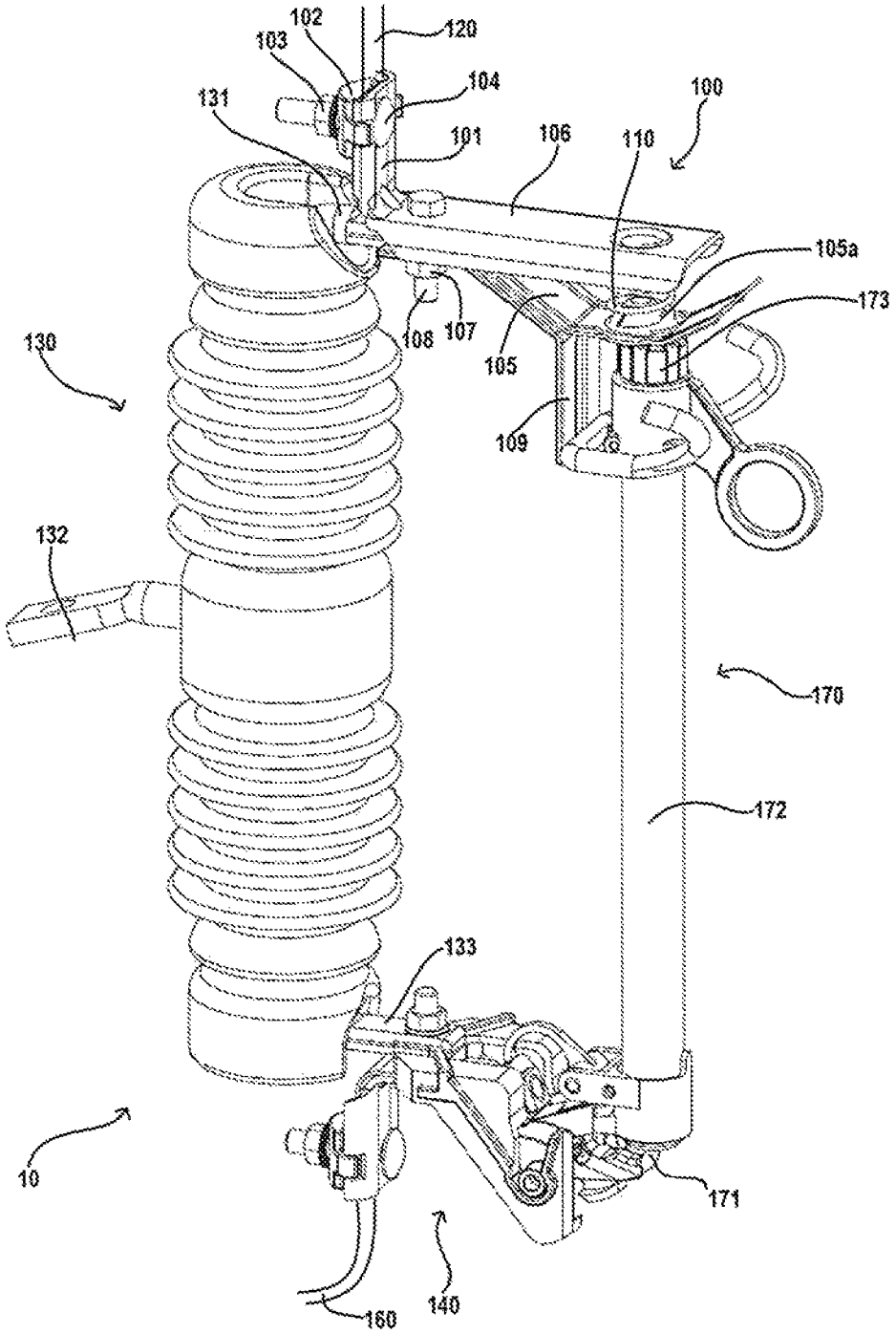
FIG. 1 shows a perspective view of a cutout according to one embodiment of the present disclosure.

FIG. 1 shows a perspective view of a cutout 10 according to an embodiment of the present disclosure.

In accordance with this embodiment, as shown in FIG. 1, the cutout 10 comprises a top contact assembly 100 which can be electrically coupled with and secured to a first electric cable 120, such as a first high voltage power line. In one example, as shown in FIG. 1, the top contact assembly 100 can comprise a top terminal strap 101 and a top terminal 102, and the first electrical cable 120 is sandwiched between an upper end of a top terminal strap 101 and a top terminal 102 riveted by a top cable nut 103 and a top cable bolt 104. One skilled in the art will readily understand that any means can be used to electrically couple a top contact assembly 100 with the first electric cable 120.

In one embodiment, the top contact assembly 100 can further comprise a top contact member 105 which is electrically coupled with and secured to the top terminal strap 101 at one end thereof. For example, as shown in FIG. 1, a lower end of the top terminal strap 101 is sandwiched between one end of the top contact member 105 and a top hood 106 riveted by a top contact nut 107 and a top contact boll 108. In this embodiment, the top terminal strap 101, the top terminal 102 and the top contact member 105 are made of electrically conducting materials, preferably copper, for letting the entire top contact member 105 act as a terminal of the first electrical cable 120.

The top contact member 105 is preferably shaped to be a strip which is flexible at one end distal from the top contact nut 107 and the top contact bolt 108 with a top recess 105*a* formed thereon. The top recess 105*a* protrudes upwards as illustrated in FIG. 1 and can be used as a terminal of the first electrical cable 120 which can facilitate to position an end of a tube assembly which will be discussed later.

In one embodiment, the top contact assembly 100 can further comprise a top contact holder 109 secured by the top contact nut 107 and the top contact bolt 108. The contact holder 109 can support the top contact member 105 in a manner of being shaped to match the top contact member 105 tightly except for the end where the top recess 105*a* is located. Preferably, there can be a top spring 110 placed between the top hood 106 and the top contact member 105 for further pressing the top contact member 105 against the contact holder 109.

In accordance with this embodiment, as shown in FIG. 1, the cutout 10 can further comprise an insulator assembly 130 which is secured to the top contact assembly 100 in a first end 131 thereof. For example, the first end 131 of the insulator assembly 130 can be sandwiched between the top contact holder 109 and the top contact member 105 at the end close to the top contact nut 107 and the top contact bolt 108. Preferably, the insulator assembly 130 and the first end 131 are made of insulating materials. Further, there is a mounting bracket 132 for ease of installation of the cutout 10.

In accordance with this embodiment, as shown in FIG. 1, the cutout 10 can further comprise a bottom contact assembly 140 which is secured to the insulator assembly 130 in a second end 133 which is preferably made of an insulating material. The bottom contact assembly 140 is electrically coupled with and secured to a second electrical cable 160, such as a second high voltage power line. The detailed descriptions of the bottom contact assembly 140 will be explained later.

In accordance with this embodiment, as shown in FIG. 1, the cutout can further comprise a tube assembly 170 provided for conducting electricity from the first electrical cable 120 to the second electrical cable 160 through the top contact assembly 100 and the bottom contact assembly 140. The tube assembly 170 has a fuselink 171 enclosed within a housing 172. The fuselink 171 can conduct electricity between the top contact assembly (100) and a bottom contact assembly (140). In one example, the fuselink 171 is removeably coupled with a cap 173 of the lube assembly 170 which is placed at the top portion of the tube assembly 170. The cap 173 is made of an electrically conducting material, preferably copper, and electrically couple with the top recess 105*a* of the top contact member 105. The fuselink 171 is capable of disconnecting the electricity transmission between the top contact assembly 100 and the bottom contact assembly 140 upon detection of a fault condition.

For example, the fuselink 171 can be composed of at least one flexible wire which will be automatically cut out when current passing therethrough has been higher than a predetermined value for a certain period. As described above, one end of the fuselink 171 is coupled with the cap 173 directly or indirectly, and the other end is electrically coupled with the second electrical cable 160 through parts of the bottom portion of the tube assembly 170 and parts of the bottom contact assembly 140. Detailed descriptions illustrating how electricity is conducted from the fuselink 171 to the second electrical cable 160 will be explained later.

Figure 2:
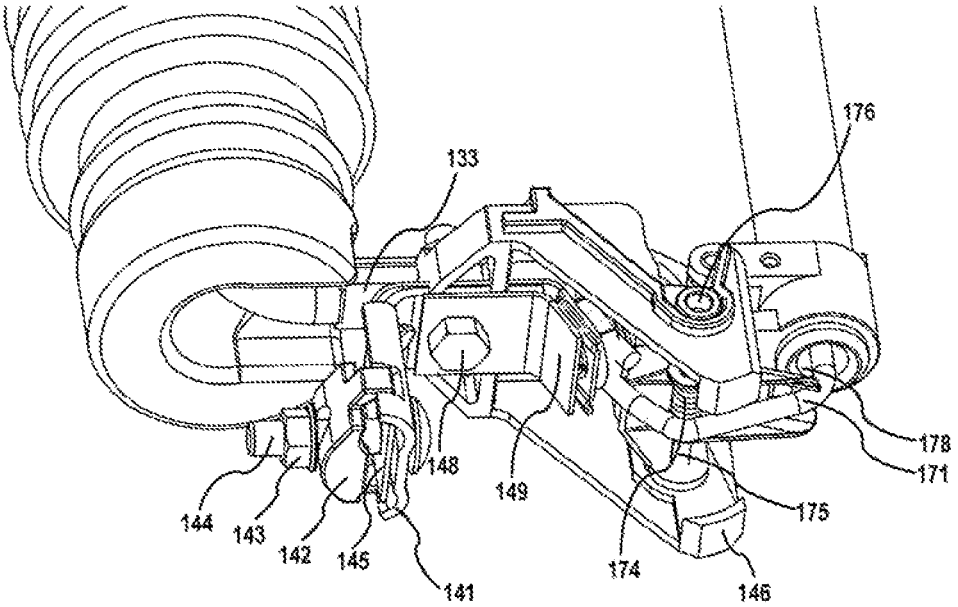
FIG. 2 shows an enlarged perspective view of the cutout observing from the bottom according to one embodiment of the present disclosure.
Figure 3:
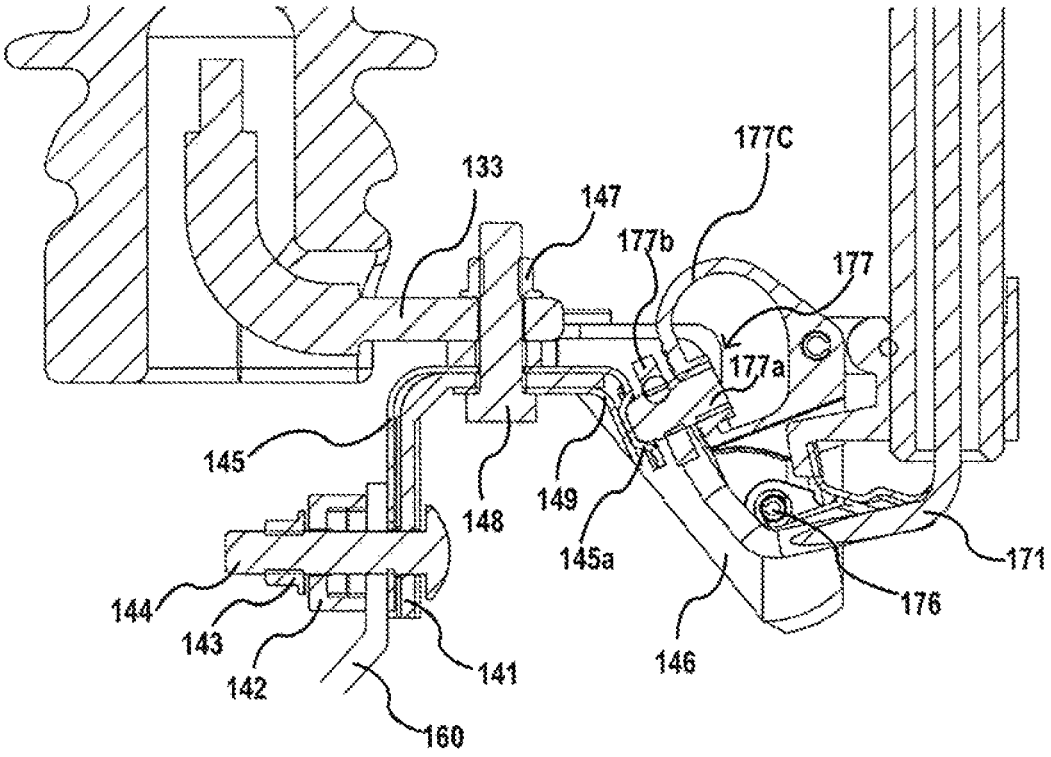
FIG. 3 shows a section view of a bottom contact assembly as well as a bottom portion of a tube assembly according to one embodiment of the present disclosure.

FIG. 2 shows an enlarged perspective view of the cutout observing from the bottom according to one embodiment of the present disclosure; and FIG. 3 shows a section view of a bottom contact assembly as well as a bottom portion of a tube assembly according to one embodiment of the present disclosure. The following descriptions of the bottom contact assembly along with the bottom portion of the tube assembly will be carried out by referring to FIG. 2 and FIG. 3 together.

As shown in FIG. 3 (also shown in FIG. 1), a bottom contact assembly 140 can be electrically coupled with and secured to the second electrical cable 160. For example, the bottom contact assembly 140 can comprise a bottom contact member 145 and a bottom terminal 142, and the second electrical cable 160 can be sandwiched between an end of a bottom contact member 145 and a bottom terminal 142 riveted by a bottom cable nut 143 and a bottom cable bolt 144.

As shown in FIG. 3, the bottom contact member 145 is preferably shaped to be a strip which has a bottom recess 145*a* formed at the other end. The entire bottom contact member 145 and the bottom terminal 142 are made of an electrically conducting material, preferably copper, for letting the entire bottom contact member 145 act as a terminal of the second electrical cable 160.

In one embodiment, as shown in FIGS. 2 and 3, the bottom contact member 145 can be supported by a bottom contact holder 141. For example, the bottom contact holder 141 is shaped to match the bottom contact member 145 tightly except for the end where the bottom recess 145*a* is located.

As clearly shown in FIG. 3, the bottom contact member 145 is preferably secured to the second end 133 of the insulator assembly 130. For example, the bottom contact member 145 can be sandwiched between the bottom contact holder 141 and the second end 133 riveted by a bottom contact nut 147 and a bottom contact bolt 148 at a location between the end securing to the second electrical cable 160 and the end forming the bottom recess 145*a*.

In one embodiment, as shown in FIGS. 2 and 3, the bottom contact assembly 140 can comprise a bottom contact frame 146 for holding the tube assembly 170 and allowing the tube assembly 170 for being rotatable. Further, as shown in FIG. 2, the bottom contact frame 146 is provided with a portion sandwiched between the second end 133 of the insulator assembly 130 and the bottom contact manner 145. In this manner, the bottom contact assembly 140 is secured to the insulator assembly 130 at the second end 133.

In one embodiment, as shown in FIGS. 2 and 3, there can be a bottom contact support 149 which is pressed against the bottom contact holder 141 by the bottom contact bolt 148 to support the bottom recess 145*a*. As shown in FIG. 3, the bottom contact support 149 provides mechanical strength for the bottom recess 145*a* while leaving with certain flexibility in order to receive and couple with a contact pan of the tube assembly 170 tightly which will be described in detail below.

In one embodiment, as shown in FIGS. 2 and 3, the tube assembly 170 is pivotally coupled with the bottom contact frame 146 via a hinge 176 which allows for a rotation of the tube assembly 170 about an axis defined by the hinge 176.

In one embodiment, the fuselink 171 extends out of the housing 172 at the bottom portion of the tube assembly 170. Because the fuselink 171 is flexible, it is wrapped into and fixed by an electrically conducting contact part 177 which is also located at the bottom portion. The contact part 177 is removeably coupled with the bottom contact member 145.

Preferably, as shown in FIG. 3, the contact part 177 is configured to have a protrusion that matches the shape of the bottom recess 145*a* in which the protrusion is received. In this embodiment, the protrusion of the contact part 177 is electrically coupled with the bottom recess 145*a* as shown in FIG. 3 to complete the electrical connection from the first electrical cable 120 to the second electrical cable 160 through the top terminal strap 101, the top contact member 105, the cap 173, the fuselink 171, the contact part 177, and the bottom contact member 145.

In one exemplary embodiment, the protrusion of the contact part 177 is capable of being tilted relative to the bottom contact member 145, more specifically to the bottom recess 145*a*, while being constantly coupled with the bottom contact member 145 for maintaining electrical connection. It should be noted that the protrusion of the contact part 177 is capable of tightly contacting the bottom recess 145*a* when the contact part 177 is pressed against the bottom recess 145*a*, by which tilling, rotating or even sliding the protrusion on the bottom contact member 145 or the bottom recess 145*a* are all possible.

In one exemplary embodiment, as shown in FIG. 3, the contact part 177 is constructed by an electrically conducting bolt 177*a* and an electrically conducting nut 177*b* by which the fuselink 171 is mounted to the contact part 177 by being tightly sandwiched between the conducting bolt 177*a* and the conducting nut 177*b*. The conducting bolt 177*a* and the conducting nut 177*b* are made of electrically conducting materials, preferably copper.

In one exemplary embodiment, the contact pan 177 is additionally constructed by a fixing member 177*c* on which the electrically conducting bolt 177*a* is riveted. By screwing the conducting nut 177*b* against the fixing member 177*c* with the fuselink 171 in between, the fuselink 171 is clamped lightly despite its variation on size. Also, at least one part of the fixing member 177*c* is mechanically coupled with the housing 172 of the lube assembly 170, which ensures a constant pressure of the contact part 177 to the bottom contact member 145 when the top contact member 105 or the top recess 105*a* receives the cap 173 of the lube assembly 170. In this configuration, fuselinks with variable sizes can be all fitted tightly to the contact part and the electrical contact between the tube assembly and the bottom assembly is constantly maintained during usage.

In one exemplary embodiment, the hinge 176 has a rod 175 by which the whole structure of the tube assembly 170 is placed onto the bottom contact assembly 140, more specifically, the bottom contact frame 146. There can also provided a flipper 178 on the rod 175 with a torsion spring 174 for exerting pressure on the fuselink 171 when the fuselink 171 is installed onto the contact part 177. For example, the fuselink 171 exits from the bottom of the housing 172 to the contact part 177 with the twisted flipper 178 pushing against the fuselink 171 and the torsion spring 174 further bending the fuselink 171. This configuration makes the fuselink 171 straight in the housing 172 and can be tightly secured to the contact part 177.

Figure 4:
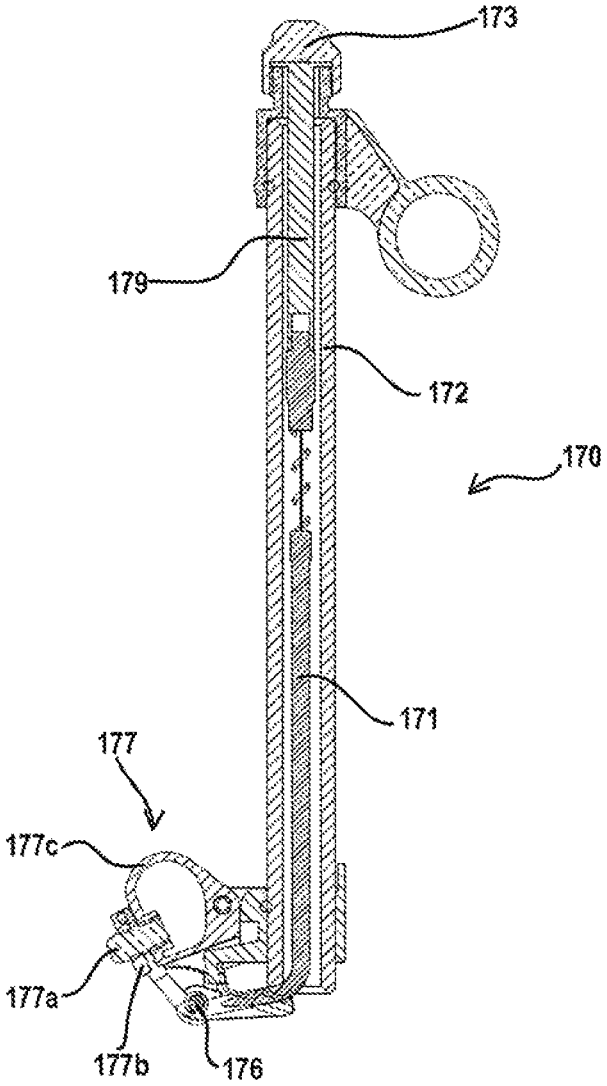
FIG. 4 shows a section view of the tube assembly shown in FIGS. 1-3.

FIG. 4 illustrates a section view of the tube assembly 170. As shown in FIG. 4, there can be further a link extender 179 in the housing 172 for connecting the cap 173 and the fuselink 171. The link extender 179 is also made of an electrically conducting material, preferably copper.

In one embodiment, the contact part 177 is electrically coupled with the bottom contact member 145 or the bottom recess 145*a* when the cap 173 of the tube assembly 170 is coupled with the top contact member 105 or the top recess 105*a*, and the contact part 177 is decoupled from the bottom contact member 145 or the bottom recess 145*a* when the cap 173 of the tube assembly 170 departs from the top contact member 105 or the top recess 105*a* in a manner of rotation about the rotating axis of the tube assembly, i.e., the axis defined by the hinge 176 and the rod 175.

Preferably, the cap 173 is configured to match the shape of the top recess 105*a* in which the cap 173 is received. The cap 173 is capable of being tilted relative to the top contact member 105, more specifically to the top recess 105*a*, while being constantly coupled with the top contact member 105 for maintaining electrical connection. It should be noted that the cap 173 is capable of tightly contacting the top recess 105*a* when the cap 173 sits in the top recess 105*a* with the top spring 110 compressed, by which tilting, rotating or even sliding the cap 173 on the top contact member 105 or the top recess 105*a* are all possible.

Advantages of this embodiment are that the number of contacts is reduced, and only the bottom terminal 142, the bottom contact member 145, the conducting bolt 177*a* and the conducting nut 177*b* should be made of electrically conducting materials for the bottom contact assembly. The rest parts can be made of materials such as composite materials or metal alloy which are less costly. As a result, an improved total conductivity with lower cost can be achieved. Meanwhile, an easier assembly process and shorter assembly time are also advantageous.

Figure 5:
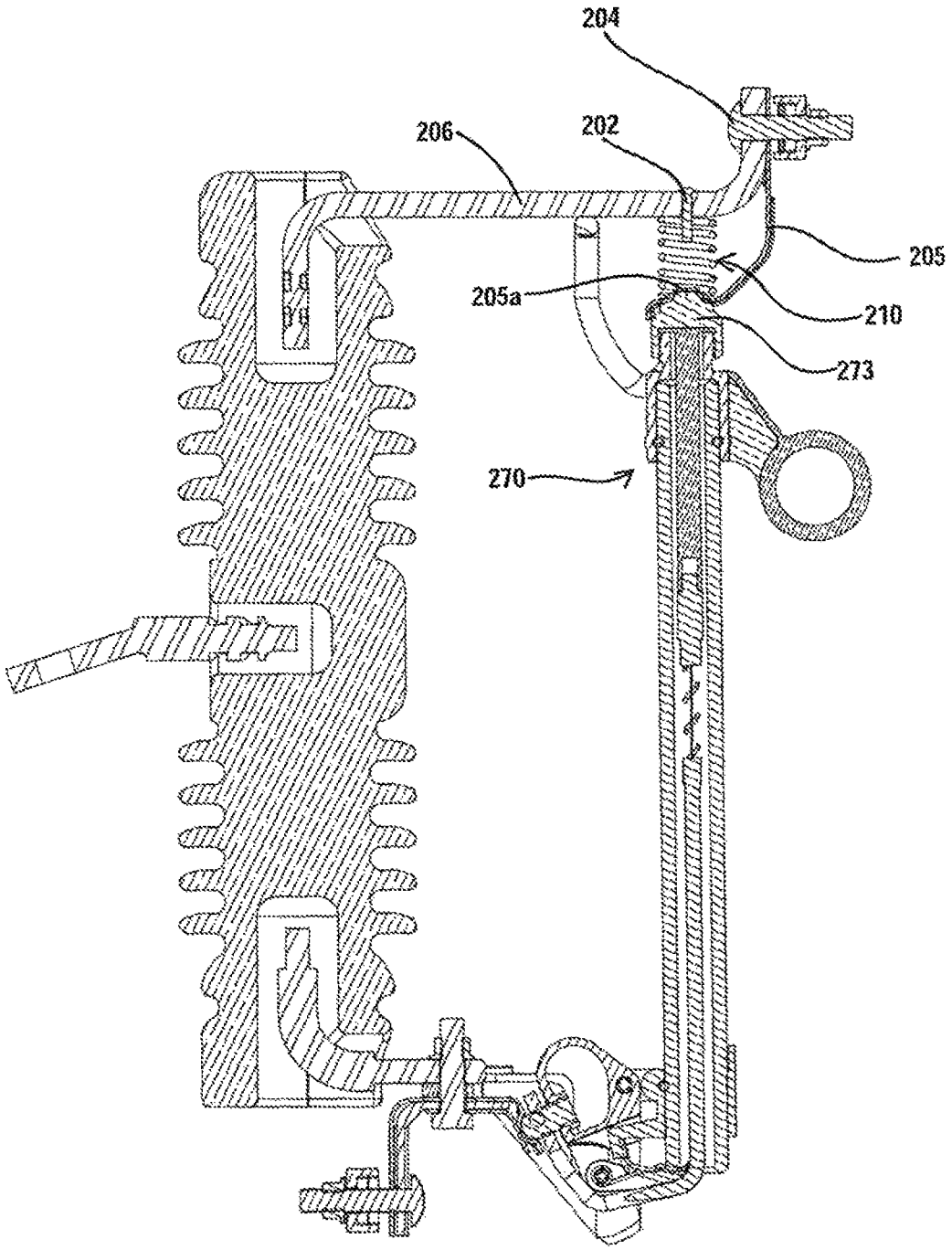
FIG. 5 allows a section view of a cutout according to another embodiment of the present disclosure.

FIG. 5 illustrates another embodiment of the cutout having a top contact assembly with different configurations.

In the embodiment as shown in FIG. 5, the top contact assembly comprises a top contact member 205, which is formed as an inseparable member. The first electrical cable (not shown) can be coupled with top contact member (205) by a top cable nut 203 and a top cable bolt 204. The other end of the top support 206 is coupled with the insulator assembly 230 front the top. There is a top recess 205*a* formed on the other end of the top contact member 205. The top recess 205*a* protrudes upwards as illustrated in FIG. 5 and can be used as a terminal of the first electrical cable which can facilitate to position the cap 273 of the tube assembly 270. There is also a top spring 210 positioned between the top recess 205*a* and the top support 206 at a position between the two ends of the top support 206. There is also a top pin 202 installed on the top support 206 protruding downwards for positioning the top spring 210 onto the top support 206.

Preferably, the cap 273 is configured to match the shape of the top recess 205*a* in which the cap 273 is received. The cap 273 is capable of being tilted relative to the top contact member 205, more specifically to the top recess 205*a*, while being constantly coupled with the top contact member 205 for maintaining electrical connection. It should be noted that the cap 273 is capable of tightly contacting the top recess 205*a* when the cap 273 sits in the top recess 205*a* with the top spring 210 compressed, by which tilting, rotating or even sliding the cap 273 on the top contact member 205 or the top recess 205*a* are all possible.

Preferably, the top contact member 205 is made of an electrically conducting material, preferably copper or copper alloy, for facilitating the electrical connection between the first electrical cable and the cap 273.

Figure 6:
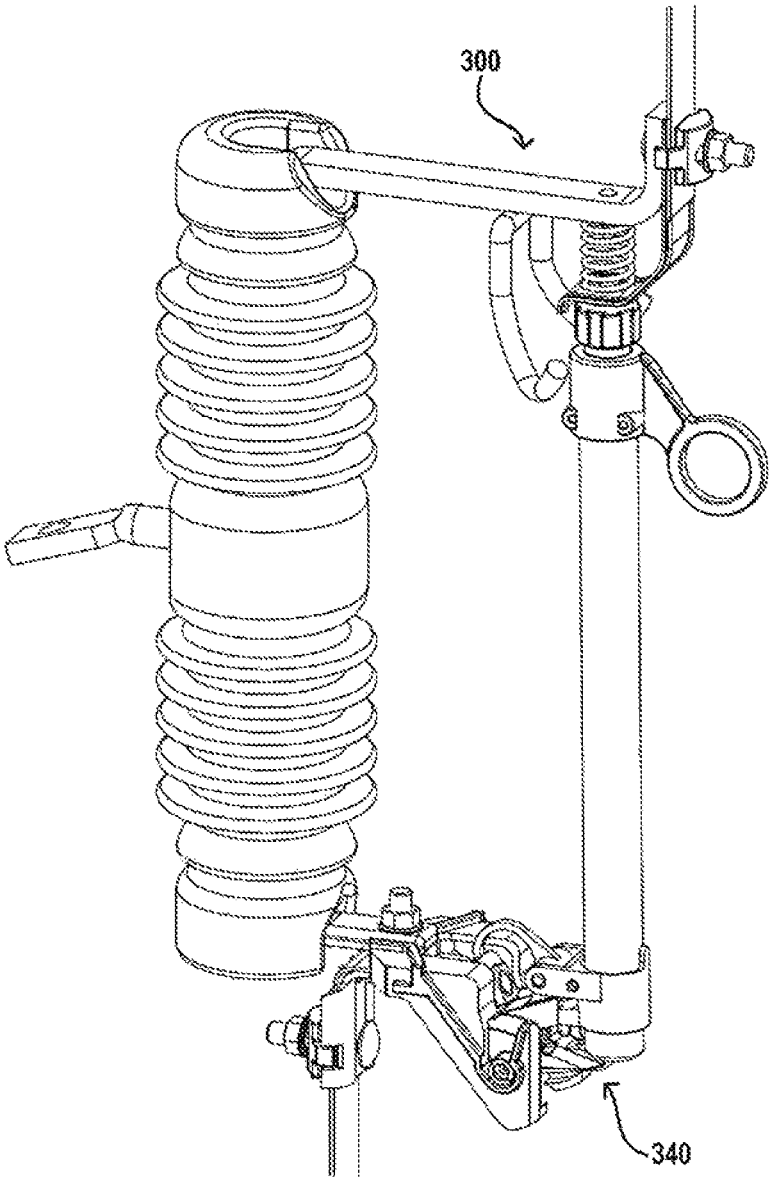
FIG. 6 shows the perspective view of the cutoff of FIG. 5.

Of course, the top contact assembly of this embodiment can be used together with the bottom contact assembly of previous embodiment as described above for constructing a cutoff as shown in FIG. 6. In this configuration, a better cost effective cutout is achieved by adopting improved top contact assembly 300 and bottom contact assembly 340.

Advantages of the top contact assembly of this embodiment are that the number of contacts is reduced. As a result of using fewer parts in the top contact assembly, the current path has been shortened. An improved total conductivity with lower cost can be achieved. Meanwhile, an easier assembly process and shorter assembly time are also advantageous. For example, the top contact assembly of this embodiment can be installed by the following steps: inserting the top pin 202 onto the top support 206; placing the top spring 210 between the top support 206 and the top contact member 205 where the top spring 210 is positioned by the top pin 202 and the top recess 205*a*; and riveting the top cable bolt 204 and top cable nut 203 to fix the top contact assembly structure.

Although claims have been formulated in this application to particular combinations of features, it should be understood that the scope of the disclosure of the present disclosure also includes any novel features or any novel combinations of features disclosed herein either explicitly or implicitly or any generalization thereof, whether or not it relates to the same invention as presently claimed in any claim. The applicants hereby give notice that new claims may be formulated to such features and/or combinations of features during the prosecution of the present application or of any further application derived therefrom.

What is claimed is:

1. A cutout comprising:

a top contact assembly capable of being electrically coupled with a first electric cable;

a bottom contact assembly capable of being electrically coupled with a second electric cable;

an insulator assembly secured to the top contact assembly in a first end thereof, and secured to the bottom contact assembly in a second end thereof opposite to the first end; and a tube assembly having a fuselink placed therein for conducting electricity between the top contact assembly and the bottom contact assembly, wherein the bottom contact assembly has a bottom contact member which is capable of being electrically coupled with the second electrical cable at one end thereof and removeably coupled with the fuselink of the tube assembly at the other end thereof such that a current path is formed from the second electrical cable to the fuselink via the bottom contact member, wherein the tube assembly comprises an electrically conducting contact part at the bottom portion thereof, the fuselink is flexibly wrapped into and fixed by the electrically conducting contact part, and the electrically conducting contact part is removeably and electrically coupled with the bottom contact member; and wherein the bottom contact member has a recess for receiving a protrusion of the electrically conducting contact part, which is shaped to be capable of being tilted relative to the bottom contact member while being constantly coupled with the bottom contact member.

2. The cutout according to claim 1, wherein the electrically conducting contact part comprises an electrically conducting bolt and a nut, the fuselink is wrapped into the electrically conducting bolt and is pressed against the nut, and the protrusion of the electrically conducting contact part is formed by an end of the electrically conducting bolt facing the bottom contact member.

3. The cutout according to claim 2, wherein the contact part further comprises a fixing member on which the electrically conducting bolt is riveted, the fuselink is capable of being fixed between the nut and the fixing member, and at least one part of the fixing member is mechanically coupled with the tube assembly.

4. The cutout according to claim 2, wherein the bolt and the nut are made of copper or copper alloy.

* * * * *